US005175894A

United States Patent [19]

Chen

[11] Patent Number: 5,175,894

[45] Date of Patent: Jan. 5, 1993

[54] TOILET FLUSHING DEVICE

[75] Inventor: Jui-Hsiang Chen, Taipei, Taiwan

[73] Assignee: Aucera Technology Corp., Taipei, Taiwan

[21] Appl. No.: 830,306

[22] Filed: Jan. 31, 1992

Related U.S. Application Data

[63] Continuation-in-part of Ser. No. 612,398, Nov. 13, 1990, abandoned.

[51] Int. Cl.[5] ..... E03D 1/36; F16K 5/12

[52] U.S. Cl. ..... 4/331; 4/366; 137/876

[58] Field of Search ..... 4/324, 329, 330, 331, 4/332, 366, 415; 137/432, 436, 442, 447, 448, 625.44, 625.46, 875, 876, 877; 251/285, 288

[56] References Cited

U.S. PATENT DOCUMENTS

| | | | |
|---|---|---|---|
| 3,147,762 | 9/1964 | Ducey | 4/331 X |
| 3,172,128 | 3/1965 | Ducey | 4/331 |
| 3,194,258 | 7/1965 | Grant | 137/432 |
| 3,501,779 | 3/1970 | Ward | 4/331 |
| 3,693,649 | 9/1972 | Gordon et al. | 137/432 X |
| 3,827,458 | 8/1974 | Arnold | 137/875 |
| 4,318,194 | 3/1982 | Pinkston | 4/366 |
| 4,408,361 | 10/1983 | Rozek | 4/331 |
| 4,420,845 | 12/1983 | Antunez | 4/366 |
| 4,918,763 | 4/1990 | Brotcke | 4/331 |
| 4,996,726 | 3/1991 | Schrock et al. | 4/331 X |

FOREIGN PATENT DOCUMENTS

| | | | |
|---|---|---|---|
| 0469593 | 11/1950 | Canada | 4/331 |
| 3512305 | 10/1986 | Fed. Rep. of Germany | 4/329 |
| 0095199 | 3/1939 | Sweden | 4/331 |
| 0095367 | 4/1939 | Sweden | 4/331 |

*Primary Examiner*—William A. Cuchlinski, Jr.
*Assistant Examiner*—John L. Beres
*Attorney, Agent, or Firm*—Morgan & Finnegan

[57] ABSTRACT

A toilet flushing device has a diverter valve which permits the supply of high pressure water to the rim flushing conduit of a toilet bowl when the toilet bowl is flushed, thereby enhancing the flushing of the toilet bowl. The diverter valve has provisions for adjusting the level of refill water inside the toilet bowl so as to help reduce water consumption.

4 Claims, 5 Drawing Sheets

TOILET FLUSHING DEVICE

This is a continuation in part application of co-pending U.S. patent application Ser. No. 07/612,398 filed Nov. 13, 1990 now abandoned.

BACKGROUND OF THE INVENTION

1. Field Of The Invention

The invention relates to a toilet flushing device, more particularly to a toilet flushing device that supplies high pressure water to the rim flushing conduit of a toilet bowl assembly so as to enhance rinsing of the inner wall of the toilet bowl.

2. Description Of The Related Art

In a conventional toilet bowl assembly, the water inside the water tank is used to remove waste inside the toilet bowl and to rinse the inner wall of the toilet bowl. Thus, more water should be provided inside the water tank so as to achieve a more effective flushing action. There is therefore a need to improve the conventional flushing method so that a more effective flushing action can be achieved with the use of less water.

One solution to the above mentioned problem is to provide the water tank at a level which is higher than that of the toilet bowl, thereby increasing the water pressure to the toilet bowl when the water tank is drained. However, this solution requires more space and is unpleasant to look at.

Another solution is to use high pressure water from an external water source so as to rinse the inner wall of the toilet bowl and to aid the flushing action of the water stored in the water tank. The normal water level inside the water tank can thus be reduced without affecting the flushing efficiency. The drawback introduced when this solution is implemented is that because of differences in the water pressure from the external water source, the level of refill water inside the toilet bowl varies. Inefficient water use can therefore result if too much refill water is in the toilet bowl.

SUMMARY OF THE INVENTION

Therefore, the objective of the present invention is to provide a toilet flushing device which supplies high pressure water to the rim flushing conduit of a toilet bowl and which has provisions for adjusting the level of refill water inside the toilet bowl.

Accordingly, the preferred embodiment of a toilet flushing device of the present invention is to be installed in a toilet bowl assembly having a water supply tank and a toilet bowl having a rim flushing conduit and a neck portion. The toilet flushing device includes a water supply pipe extending into the water supply tank and having a lower end connected to an external pressurized water source; a vertical refill pipe provided inside the water supply tank; a float-controlled valve means provided on an upper end of the water supply pipe to control water flow from the supply pipe to the refill pipe; a manually operated flush valve means for discharging water inside the water tank to the neck portion of the toilet bowl; and a diverter valve means including:

a valve housing defining an enclosed hollow space which is substantially circular in cross-section, said valve housing including the vertical refill pipe, a transverse inlet pipe receiving water from the supply pipe and a transverse supply line disposed opposite to the inlet pipe at a level higher than the inlet pipe, said supply line being connected to and supplying water to the rim flushing conduit of the toilet bowl; said refill pipe, said inlet pipe and said supply line being communicated with the hollow space of the valve housing;

a flap rotatably provided inside the hollow space of the valve housing, said flap having a first portion disposed adjacent to the inlet pipe and a second portion disposed adjacent to the supply line, said flap further having an axle extending through a front side of the valve housing, said second portion of the flap having a distal end which forms a clearance with an inner wall surface of the valve housing inside the hollow space;

said valve housing further having a stationary upper stop and a movable lower stop projecting outwardly from the front side of the valve housing in the direction of the axle, said lower stop being angularly spaced from the upper stop and being adjustably mounted on the front side of the valve housing so as to vary the angular distance between the upper and lower stops;

a lever member disposed outside the valve housing and having a first end portion extending between the upper and lower stops, an intermediate portion connected to the axle of the flap and a second end portion provided with a counterweight, said counterweight rotating the lever member so that the first end portion normally abuts against the upper stop so as to place the flap in a first position wherein water from the inlet pipe is directed to the supply line; and a float movably sleeved on the refill pipe and tied to the first end portion of the lever member, said float ball gradually moving downward in response to a decrease in the water level inside the water tank when the flush valve means is operated to pull the lever member to abut against the lower stop so as to rotate the flap from the first position to a second position wherein a large portion of water from the inlet pipe flows through the refill pipe and wherein a small portion of water from the inlet pipe flows through the clearance and into the supply line, thus refilling the water tank and the toilet bowl.

The position of the lower stop on the front side of the valve housing is adjusted so as to control the rotation of the flap inside the hollow space, thereby adjusting the water flow through the clearance when the toilet bowl is refilled.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
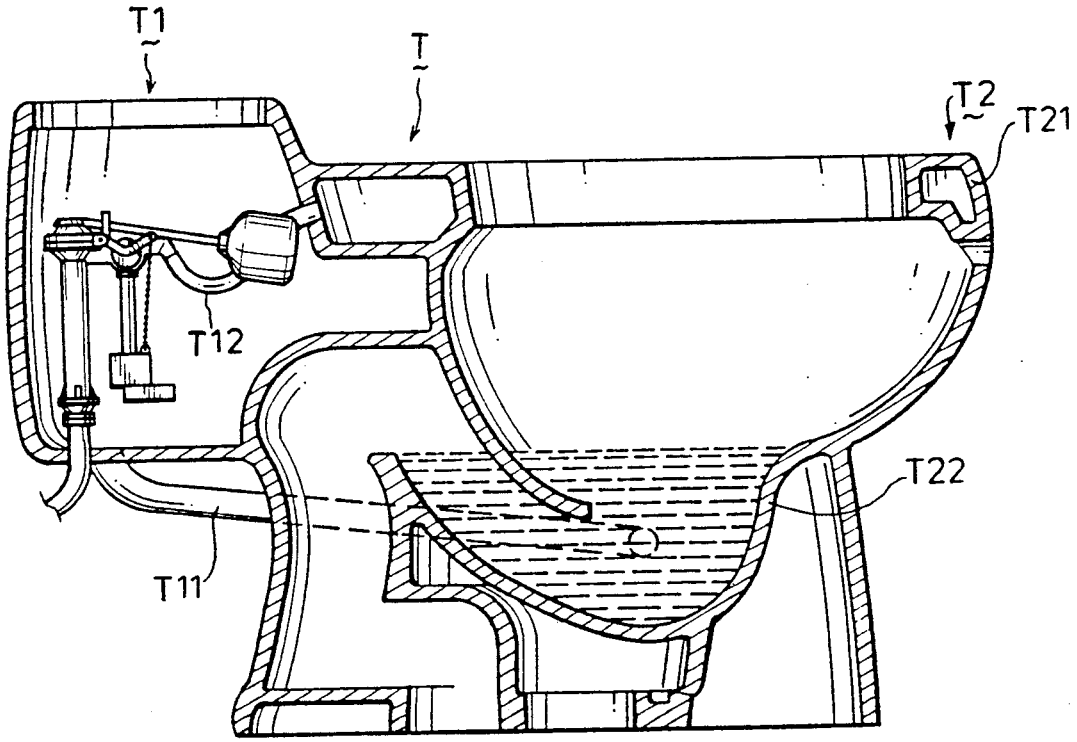
FIG. 1 is an illustration of the preferred embodiment of a toilet flushing device according to the present invention when installed in a toilet bowl assembly.
Figure 2:
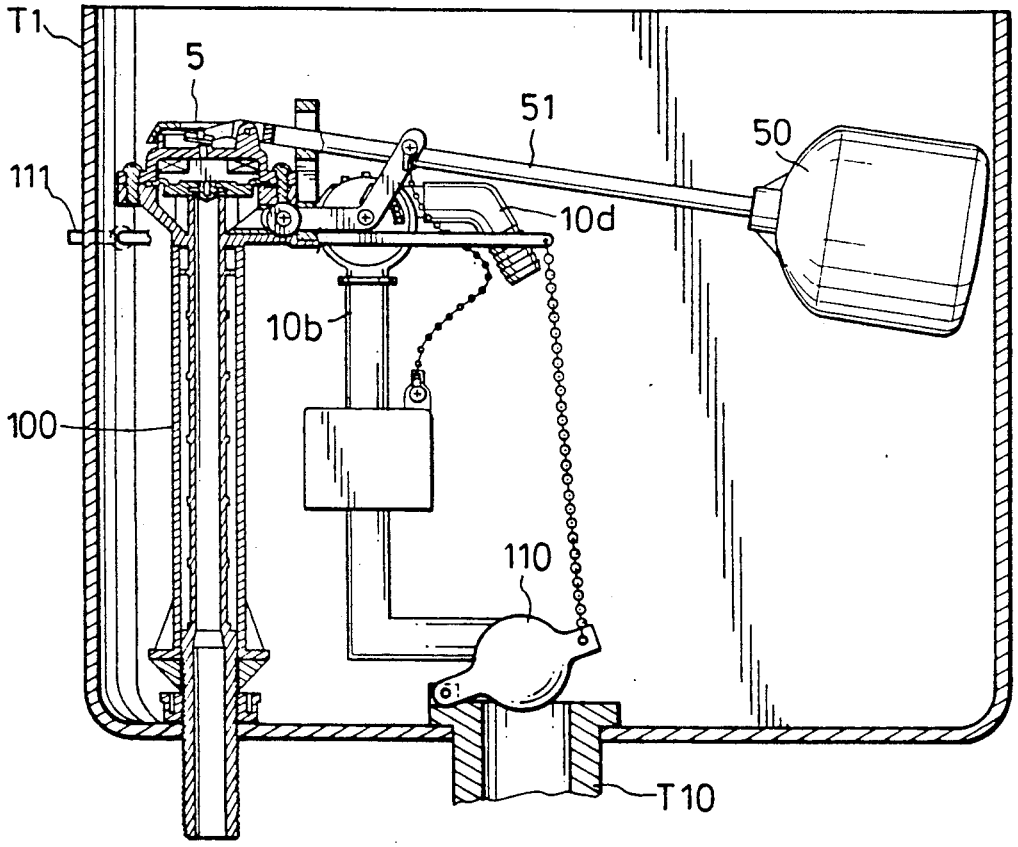
FIG. 2 is a partly sectional view of the toilet flushing device of the present invention when in a normal state.

Referring to FIGS. 1 and 2, the preferred embodiment of a toilet flushing device according to the present invention is to be installed in a toilet bowl assembly (T). The toilet bowl assembly (T) includes a water supply tank (T1) and a toilet bowl (T2) having a rim flushing conduit (T21) and a neck portion (T22). A water supply pipe (100) extends into the water supply tank (T1) and has a lower end connected to an external pressurized water source and an upper end provided with a conventional ballcock valve (5). A rod (51) connects the ballcock valve (5) to a float (50). The water supply tank (T1) is provided with a discharge outlet (T10). A flapper valve (110) normally closes the discharge outlet (T10) and has one end hinged to the water supply tank (T1). The other end of the flapper valve (110) is tied to the actuating arm of a conventional flush handle (111), which is mounted on the exterior of the tank (T1) by means of a cable or chain. The flush handle (111) is operated so as to lift the flapper valve (110) to allow water in the tank (T1) to flow through the discharge outlet (T10). A discharge pipe (T11) directs water flowing through the discharge outlet (T10) to the neck (T22) of the toilet bowl (T2) in a conventional manner. As the water level in the tank (T1) drops, the float (50) will be lowered, thereby opening the ballcock valve (5). Water from the supply pipe (100) is directed to a diverter valve means (1) of the toilet flushing device so as to refill the tank (T1) until the normal water level is reached, whereupon the float (50) closes the ballcock valve (5).

Figure 3:
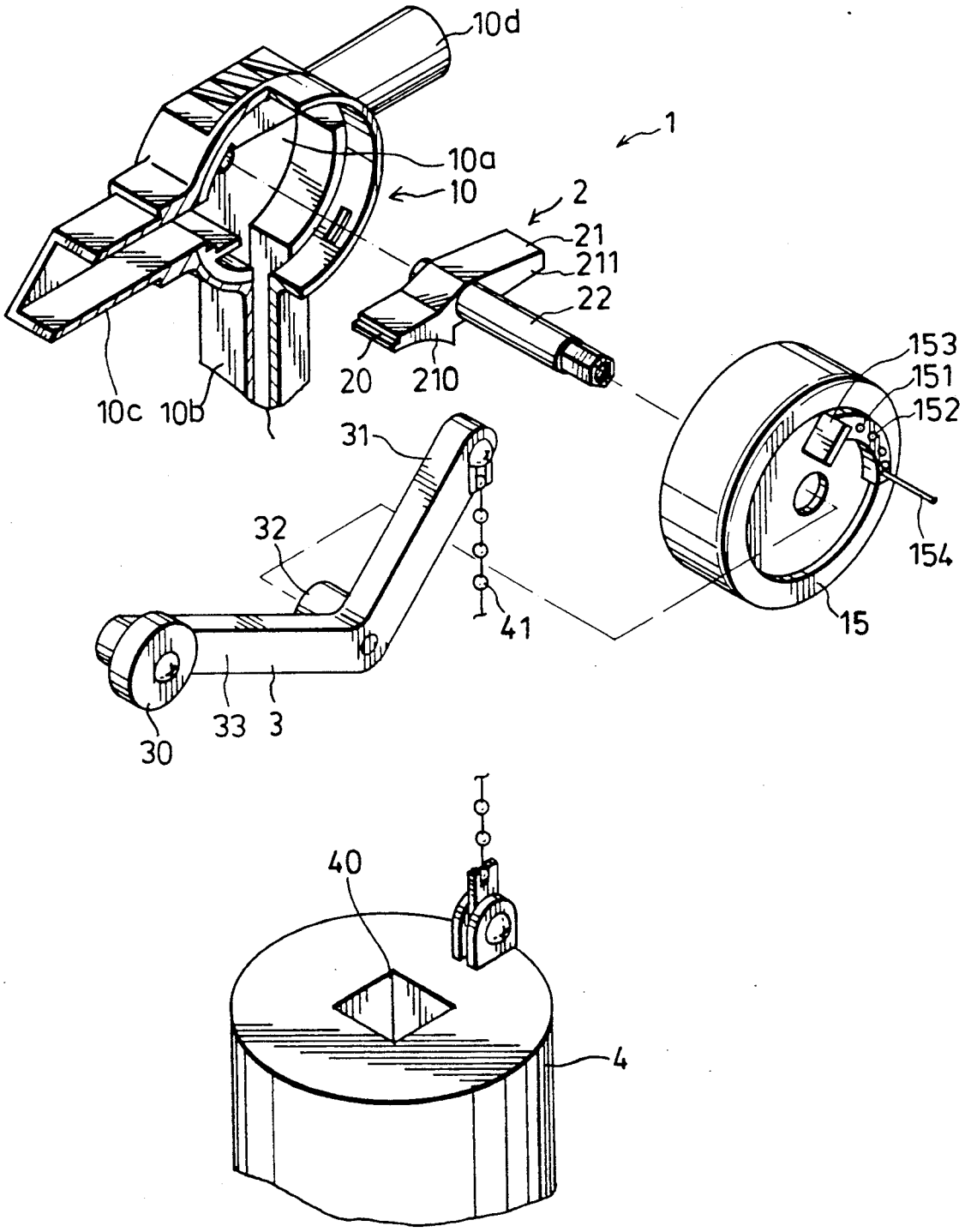
FIG. 3 is an exploded view of a diverter valve means of the toilet flushing device.

Referring to FIG. 3, the diverter valve means (1) of the present invention includes a valve housing (10), a flap (2), a lever member (3) and a secondary float (4).

The valve housing (10) defines an enclosed hollow space (10*a*) which is substantially circular in crosssection. The valve housing (10) has a vertical refill pipe (10*b*), a transverse inlet pipe (10*c*) which receives water from the supply pipe (100) and a transverse supply line (10*d*) which is disposed opposite to the inlet pipe (10*c*) at a level higher than the inlet pipe (10*c*). The supply line (10*d*) supplies water to the rim flushing conduit (T21) of the toilet bowl (T2) via a discharge pipe (T12). The refill pipe (10*b*), the inlet pipe (10*c*) and the supply line (10*d*) are communicated with the hollow space (10*a*).

The flap (2) is rotatably provided inside the hollow space (10*a*) of the valve housing (10). The flap (2) includes a plate member (21) which is pivoted about an axle (22) on the axis of the enclosed hollow space (10*a*). The plate member (21) has a first portion (210) disposed adjacent to the inlet pipe (10*c*) and a second portion (211) disposed adjacent to the supply line (10*d*). The axle (22) has one end which extends through a front cover (15) of the valve housing (10). An arc-shaped strip (151) projects outwardly from the cover (15). The strip (151) is formed with a plurality of spaced insert holes (152). A stationary upper stop (153) projects outwardly from the cover (15) adjacent to an upper end of the arcual strip (151). A pin (154) is selectively inserted in one of the holes (152) so as to vary the angular distance between the pin (154) and the upper stop (153), as will be detailed in the succeeding paragraphs.

The flap (2) is turnable between a first position, wherein water from the inlet pipe (10*c*) flows through the supply line (10*d*) (Refer to FIG. 2A), and a second position, wherein water from the inlet pipe (10*c*) flows through the refill pipe (10*b*) (Refer to FIG. 2B). The first portion (210) of the plate member (21) has a stepped distal end (20).

The lever member (3) is substantially V-shaped and has one end portion (31) which extends between the stop (153) and the pin (154). The lever member (3) is disposed outside the valve housing (1) and has an intermediate vertex portion (32) connected to the axle (22) of the flap (2). An opposite end portion (33) of the lever member (3) is provided with a counterweight (30).

The secondary float (4) has an axial through hole (40) and is movably sleeved on the refill pipe (10*b*). A beaded chain (41) connects the end portion (31) of the lever member (3) to the secondary float (4).

Figure 2A:
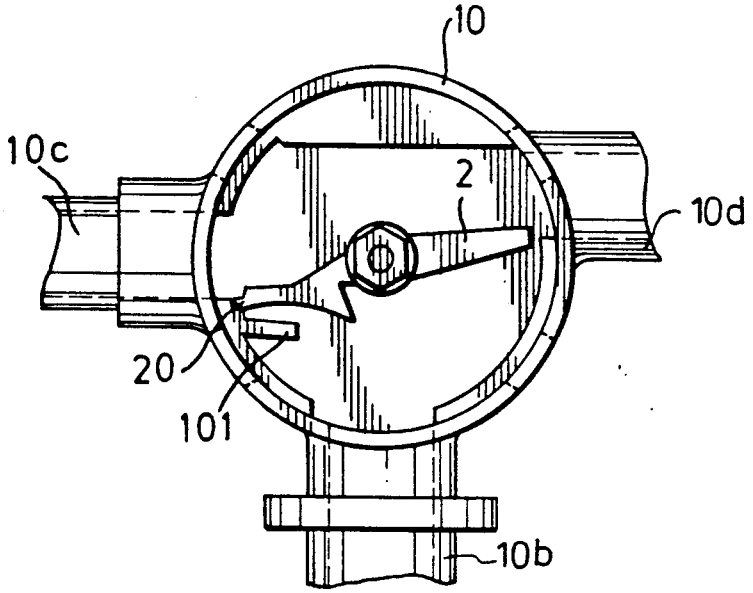
FIG. 2A illustrates the position of a flap of the toilet flushing device when the latter is in the normal state.

Referring once more to FIGS. 1, 2 and 3, when the tank (T1) is initially full, the secondary float (4) floats along the water level and does not exert any pulling force on the beaded chain (41). The counterweight (30) rotates the lever member (3) such that the end portion (31) of the latter abuts against the stop (153). The flap (2) is correspondingly rotated counterclockwise to the first position, as shown in FIG. 2A, since the flap (2) is connected to the lever member (3). When the flush handle (111) is operated, the flapper valve (110) is lifted so as to allow water in the tank (T1) to flow through the discharge outlet (T10) and into the neck (T22) of the toilet bowl (T2). As the water level in the tank (T1) drops, the floats (4, 50) are lowered, thereby opening the ballcock valve (5). High pressure water from the supply pipe (100) enters the diverter valve means (1) and is directed by the flap (2) to the supply line (10*d*). High pressure water thus enters the rim flushing conduit (T21), thereby effectively rinsing the inner wall of the toilet bowl (T2).

Figure 4A:
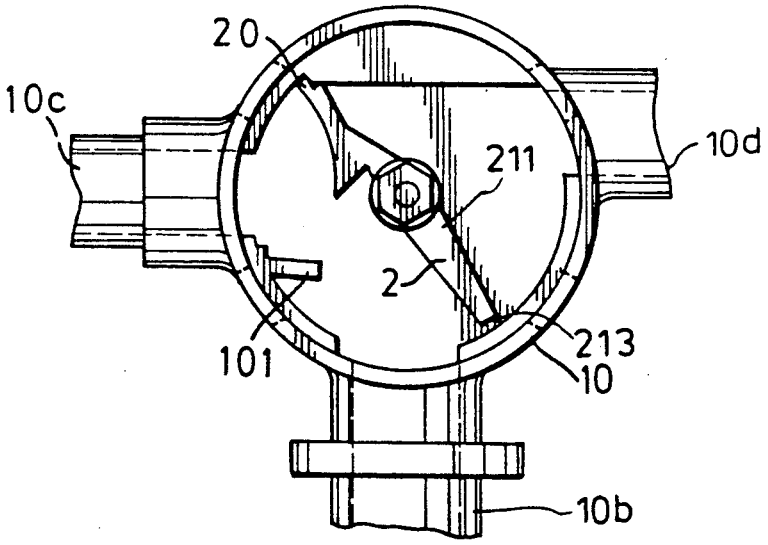
FIG. 4A illustrates the position of the flap of the toilet flushing device when the latter is in the tank-refilling state.
Figure 4:
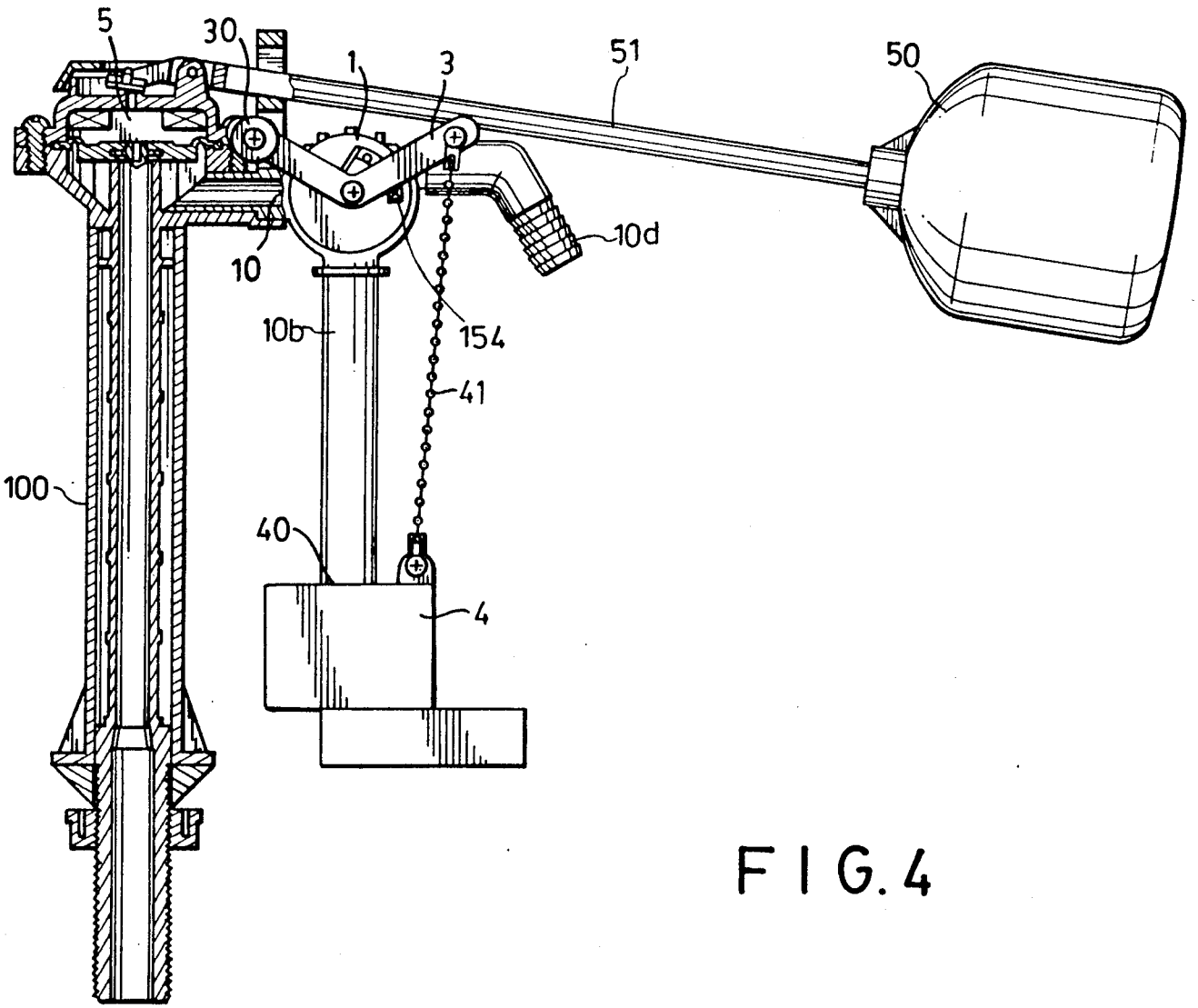
FIG. 4 is a partly sectional view of the toilet flushing device of the present invention when in a tank-refilling state.

Referring to FIGS. 4 and 4A, as the water level in the tank (T1) continues to gradually decrease, the secondary float (4) similarly moves downward and eventually pulls the beaded chain (41) to cause clockwise rotation of the lever member (3), thus consequently rotating the flap (2) from the first position to the second position until the end portion (31) of the lever member (3) abuts against the pin (154). Water from the inlet pipe (10*c*) is directed by an inward flange (101) toward the flap (2). The flap (2) then diverts a large portion of water from the inlet pipe (10*c*) to the refill pipe (10*b*) so as to refill the water tank (T1). The distal end of the second portion (211) of the flap (2) forms a clearance (213) with the inner wall surface of the valve housing (10) inside the hollow space (10*a*). A small portion of water flowing into the hollow space (10*a*) enters the supply line (10*d*) via the clearance (213) and is used to refill the toilet bowl (T2). The range of angular rotation of the lever member (3) and the flap (2) is controlled by varying the position of the pin (154) on the arc-shaped strip (151) so as to control water flow through the clearance (213) when refilling the toilet bowl (T2). More water flows into the supply line (10*d*) when the pin (154) is moved to an insert hole (152) which is disposed at a higher level. Accordingly, less water flows through the supply line (10*d*) when the pin (154) is placed on a lowermost one of the insert holes (152), as shown in FIG. 4A.

As the water level in the tank (T1) rises, the floats (4, 50) gradually move upward until the normal water level is reached, whereupon the float (50) closes the ballcock valve (5). At this stage, the secondary float (4) ceases to pull the beaded chain (41), thereby causing the counterweight (30) to rotate the lever member (3) and consequently move the flap (2) back to the first position, as shown in FIG. 2A.

The stepped distal end (20) of the flap (2) provides a stabilizing effect when the flap (2) is in the first position and high pressure water enters the hollow space (10*a*) of the valve housing (1). High pressure water entering the hollow space (10*a*) of the valve housing (1) tends to cause untimely clockwise rotation of the flap (2). The stepped distal end (20) provides a contact surface to resist the untimely rotation of the flap (2).

The advantages of using the preferred embodiment of a toilet flushing device according to the present invention are as follows:

1. The preferred embodiment utilizes high pressure water from the supply pipe (100) for rinsing the inner wall of the toilet bowl (T2). Less water is required to accomplish effective flushing action. Furthermore, there is no need to place the water tank (T1) at a higher level, as is taught in the prior art.

2. Because of differences in the incoming water pressure, the position of the pin (154) on the cover (15) of the valve housing (10) may be adjusted so as to control the level of refill water in the toilet bowl (T2), thus permitting further reductions in water consumption.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A toilet flushing device to be installed in a toilet bowl assembly having a water supply tank and a toilet bowl having a rim flushing conduit and a neck portion, said toilet flushing device including a water supply pipe extending into said water supply tank and having a lower end connected to an external pressurized water source; a vertical refill pipe provided inside said water supply tank; a float-controlled valve means provided on an upper end of said water supply pipe to control water flow from said supply pipe to said refill pipe; a manually operated flush valve means for discharging water inside said water tank to said neck portion of said toilet bowl; the improvement comprising a diverter valve means including:

a valve housing defining an enclosed hollow space which is substantially circular in cross-section, said valve housing including said vertical refill pipe, a transverse inlet pipe receiving water from said supply pipe and a transverse supply line disposed opposite to said inlet pipe at a level higher than said inlet pipe, said supply line being connected to and supplying water to said rim flushing conduit of said toilet bowl; said refill pipe, said inlet pipe and said supply line being communicated with said hollow space;

a flap rotatably provided inside said hollow space of said valve housing, said flap having a first portion disposed adjacent to said inlet pipe and a second portion disposed adjacent to said supply line, said flap further having an axle extending through a front side of said valve housing, said second portion having a distal end which forms a clearance with an inner wall surface of said valve housing inside said hollow space;

said valve housing further having a stationary upper stop and a movable lower stop projecting outwardly from said front side of said valve housing in the direction of said axle, said lower stop being angularly spaced from said upper stop and being adjustably mounted on said front side of said valve housing so as to vary the angular distance between said upper and lower stops;

a lever member disposed outside said valve housing and having a first end portion extending between said upper and lower stops, an intermediate portion connected to said axle of said flap and a second end portion provided with a counterweight, said counterweight rotating said lever member so that said first end portion normally abuts against said upper stop so as to place said flap in a first position wherein water from said inlet pipe is directed to said supply line; and a float movably sleeved on said refill pipe and tied to said first end portion of said lever member, said float gradually moving downward, in response to a decrease in the water level inside said water tank when said flush valve means is operated, to pull said lever member to abut against said lower stop so as to rotate said flap from said first position to a second position wherein a large portion of water from said inlet pipe flows through the refill pipe and a small portion of water from said inlet pipe flows through said clearance into said supply line, to refill said water tank and said toilet bowl respectfully;

whereby, the position of said lower stop on said front side of said valve housing is adjusted so as to control rotation of said flap inside said hollow space, thereby adjusting the water flow through said clearance when said toilet bowl is refilled.

2. The toilet flushing device as claimed in claim 1, wherein said valve housing has an arc-shaped strip projecting outwardly from said front side of said valve housing, said strip being provided with a plurality of spaced insert holes, said upper stop being disposed adjacent to an upper end of said strip, said lower stop being a pin which is inserted in a selected one of said insert holes.

3. The toilet flushing device as claimed in claim 2, wherein said lever member is substantially V-shaped and has a vertex secured to said axle.

4. The toilet flushing device as claimed in claim 1, wherein said first portion of said flap has a stepped distal end which provides a stabilizing effect to prevent untimely rotation of said flap from said first position to said second position when high pressure water from said inlet pipe enters said hollow space of said valve housing.

* * * * *